US007484670B2

(12) United States Patent
Kipp

(10) Patent No.: US 7,484,670 B2
(45) Date of Patent: Feb. 3, 2009

(54) BLASTING METHOD AND APPARATUS

(76) Inventor: Jens Werner Kipp, Klashofsiedlung 3, Bielefeld (DE) 33659

( * ) Notice: Subject to any disclaimer, the term of this patent is extended or adjusted under 35 U.S.C. 154(b) by 318 days.

(21) Appl. No.: 10/528,390

(22) PCT Filed: Jul. 1, 2003

(86) PCT No.: PCT/EP03/07011

§ 371 (c)(1),
(2), (4) Date: Mar. 18, 2005

(87) PCT Pub. No.: WO2004/033154

PCT Pub. Date: Apr. 22, 2004

(65) Prior Publication Data

US 2006/0011734 A1 Jan. 19, 2006

(30) Foreign Application Priority Data

| | | |
|---|---|---|
| Sep. 20, 2002 | (DE) | 102 43 693 |
| Dec. 24, 2002 | (DE) | 102 61 013 |
| Feb. 7, 2003 | (DE) | 103 05 269 |

(51) Int. Cl.

| | |
|---|---|
| ***B05B 17/04*** | (2006.01) |
| ***B05B 7/10*** | (2006.01) |
| ***B05B 7/12*** | (2006.01) |

(52) U.S. Cl. ..... 239/11; 239/406; 239/434; 239/417.5

(58) Field of Classification Search ..... 239/11, 239/398, 399, 407, 413, 461, 463, 483, 589, 239/592, 406, 147.5, DIG. 12, 434; 451/39, 451/75, 99–102

See application file for complete search history.

(56) References Cited

U.S. PATENT DOCUMENTS

| | | | | |
|---|---|---|---|---|
| 4,038,786 | A | 8/1977 | Fong | |
| 4,806,171 | A | 2/1989 | Whitlock et al. | |
| 5,125,979 | A | 6/1992 | Swain et al. | |
| 5,184,427 | A * | 2/1993 | Armstrong | 451/7 |
| 5,616,067 | A | 4/1997 | Goenka | |
| 5,679,062 | A | 10/1997 | Goenka | |
| 5,725,154 | A | 3/1998 | Jackson | |
| 5,785,581 | A * | 7/1998 | Settles | 451/99 |

FOREIGN PATENT DOCUMENTS

| | | |
|---|---|---|
| DE | 4437933 A1 | 11/1995 |
| DE | 198 07 917 A1 | 8/1999 |
| EP | 0515368 A1 | 8/1991 |
| WO | WO 00/74897 A1 | 12/2000 |

* cited by examiner

*Primary Examiner*—Davis D Hwu
(74) *Attorney, Agent, or Firm*—Rothwell, Figg, Ernst & Manbeck P.C.

(57) ABSTRACT

Blasting method for cleaning surfaces, wherein a carrier gas is supplied under pressure through a blasting line (10) to a blasting nozzle (14), and liquid $CO_2$ is supplied through a feed line (32), is transformed into dry snow through expansion and is fed into the blasting line (10), characterised in that $CO_2$ from the feed line (32) is introduced into the blasting line (10) through an expansion volume (34) having an enlarged cross section.

27 Claims, 4 Drawing Sheets

BLASTING METHOD AND APPARATUS

CROSS-REFERENCE TO RELATED APPLICATION

This application is a National Phase of PCT International Application Ser. No. PCT/EP03/07011, filed Jul. 1, 2003.

FIELD OF THE INVENTION

The invention relates to a blasting method for cleaning surfaces, wherein a carrier gas is supplied under pressure through a blasting line to a blasting nozzle, and liquid $CO_2$ is supplied through a feed line, is transformed into dry snow by expansion and is fed into the blasting line, as well as an apparatus for carrying out this method.

DESCRIPTION OF THE BACKGROUND ART

A blasting method of this type has been disclosed in U.S. Pat. No. 5,616,067 A. The $CO_2$ is introduced in liquid form into an annular chamber which surrounds the blasting line through which compressed air is passed, and from there the $CO_2$ is fed into the blasting line through a circular array of converging capillaries, so that the expansion occurs only upon entry into the blasting line. The dry snow thus created is entrained and accelerated by the compressed air and is jetted onto the workpiece to be cleaned via the blasting nozzle. This method is particularly intended for gently cleaning pressure-sensitive surfaces in such as electronic circuit boards.

U.S. Pat. No. 5,679,062 describes a blasting method in which gaseous or liquid $CO_2$ or a mixture of gas and liquid is expanded at the outlet of a nozzle and is introduced into an enlarged vortex chamber in which a part of the gaseous and/or liquid $CO_2$ is transformed into dry snow. The outlet of the vortex chamber is directly coupled to the blasting nozzle. Here, the carrier gas is formed by the gaseous $CO_2$ that has been supplied or is produced through evaporation.

U.S. Pat. No. 5,725,154 A describes a blasting method in which dry snow is produced by expanding liquid $CO_2$ by means of an expansion valve. Through a thin tube which is coaxially surrounded by a tube for supplying the carrier gas, the dry snow is supplied to a blasting pistol which then jets out in a mixture of carrier gas and dry snow.

WO 00/74 897 A1 discloses a blasting apparatus in which liquid $CO_2$ is supplied via a capillary which opens into a conically divergent nozzle the diameter of which increases towards the outlet to approximately three times the diameter of the capillary. This nozzle is surrounded by an annular Laval nozzle in which the carrier gas that has been supplied under pressure is accelerated to supersonic speed. The mouths of the $CO_2$ nozzle and the Laval nozzle are level with one another, so that two concentric jets are produced, i.e. an inner jet consisting mainly of dry ice and a jacket jet which is to accelerate the dry ice outside of the nozzle.

Also in applications in which larger surfaces such as the internal surfaces of pipes or boilers in industrial equipment shall be freed of firmly adhering incrustations, the use of dry ice or dry snow as blasting material, depending on the type of incrustations, is frequently desirable, because the low temperature of the dry ice or dry snow makes the material to be removed more brittle. When particles of dry snow penetrate into the layer to be removed with sufficient kinetic energy, a cleaning effect is achieved by the fact that the particles of dry snow, when penetrating into the layer to be removed, are evaporated abruptly and thus blow off parts of the layer to be removed. Another advantage is that no additional means are necessary for discharging the used blasting material, because the dry snow evaporates to gaseous CO2.

However, the blasting methods described above are not suitable for these kinds of application, because the achievable volume flow rates and jet speeds are not sufficient and/or because dry snow is not produced in a sufficient amount or does not have the correct composition, so that the kinetic energy of the particles of dry snow is to small.

For this reason, for cleaning larger, heavily contaminated surfaces, blasting equipments have heretofore been used in which dry ice or dry snow is stored in solid form in suitable cooling tanks and is metered into the flow of compressed air. The compressed air and the dry snow serving as blasting material are then delivered together through a pressure hose which connects the blasting equipment to the blasting nozzle. However blasting methods and apparatus of this type require cumbersome installations and correspondingly high equipment costs as well as high expenses for storing the dry snow.

SUMMARY OF THE INVENTION

It is therefore an object of the invention to provide blasting methods and blasting apparatus in which high blasting powers and high cleaning effects can be achieved with little effort.

This object is achieved with the features disclosed herein.

According to the invention, in a method of the type indicated in the opening paragraph, the CO2 is supplied from the feed line into the blasting line via an enlarged expansion volume.

Surprisingly, it has been shown that, by suitably dimensioning the expansion volume and/or by suitably conducting the method, it is possible to create large amounts of dry snow having a high cleaning effect. In particular, it is possible with this method to achieve high flow rates of 0.75 to 10 m3/min or more, so that even larger or heavily contaminated surfaces can be cleaned efficiently. Since the dry snow serving as the blasting material is created from liquid CO2 only at the time when the blasting method is practised, it is possible to save the high costs for the blasting equipment and for storing the dry snow, which have heretofore been necessary.

According to one embodiment, the production of strongly abrasive dry snow or dry ice is achieved simply by providing an expansion volume with sufficiently large volume. In experiments it was possible to multiply the cleaning effect by increasing the expansion volume, when the other conditions were left unchanged. This surprising phenomenon is presumably due to the fact that the larger expansion volume between the mouth of the feed line and the point of entry into the blasting line leads to a temporary reduction of the flow velocity and hence to an increased particle density, so that the finely dispersed dry snow particles that are at first created upon expansion agglomerate or condense to larger particles before they are entrained by the flow of the carrier gas. This leads to the production of snow particles which have a larger mass and then produce a high cleaning effect because of their higher kinetic energy.

For the volume V of the expansion volume in relation to the cross-sectional area A of the feed line for the liquid $CO^2$ the following relation should be observed:

$$V^{1/3}/A^{1/2}>3 \text{ or preferably } V^{1/3}/A^{1/2}>10.$$

Alternatively, the volume V of the expansion volume may be given in relation to a flow rate $\phi$ of liquid $CO_2$. In this case, the relation which should be observed is:

$$V/\phi>0.2 \text{ m}^3 \text{ s/kg, preferably } V/\phi>0.6 \text{ m}^3 \text{ s/kg.}$$

The method may also be practised with a smaller volume of the expansion volume, if the smaller volume is compensated for by a larger pressure and a correspondingly increased flow rate of the carrier gas and/or if the expansion volume has a sufficient length, for example a length at least 15 or 30 mm.

The temperature prevailing in the expansion volume is considered to be an important factor for the production of strongly abrasive particles of dry ice. This temperature should preferably be low, preferably below −40° C. When the method according to the invention is practised with a sufficient flow rate of carrier gas (e.g. 0.75 $m^3$/min) and when the flow rate of liquid $CO_2$ is in an optimal ratio to the flow rate of air, e.g. in the order of magnitude of 0.1 to 0.4 kg $CO_2$ per $m^3$ carrier gas (volume under atmospheric pressure), the cooling effect caused by the evaporation of $CO_2$ appears to be so large that the expansion volume is kept on a sufficiently low temperature.

A good thermal insulation of the expansion volume permits to exploit the cooling effect more efficiently and thereby to achieve the even lower temperatures in the expansion volume and/or to reduce the expansion volume. Thus, according to another embodiment of the method, an expansion volume is thermally insulated from the environment, so that the desired high cleaning effect can also be achieved with a small volume of the expansion volume and small flow rates. Here, it has been found to be advantageous that the feed line for liquid CO2 is also thermally insulated from the environment and has a good thermal contact with the walls of the expansion volume (e.g. by means of a heat exchanger), so that the liquid CO2 is pre-cooled already to some extent in the feed line.

It has been found in experiments that a relatively strong crust of dry ice is deposited already after a short time of operation on the walls of the expansion volume and/or the walls of the blasting line, and the crust may even extend into the blasting nozzle. This crust of dry ice improves the thermal insulation and cooling of the expansion volume and may also contribute directly to the creation of relatively coarse and hard particles of dry ice having a high cleaning effect. When the dry snow which is first produced by expanding the liquid CO2 is swirled, it impinges onto the walls of the expansion volume and/or the blasting line with high velocity, so that the above-mentioned, relatively strong and condensed crust is built-up there. On the other hand, the supply of heat via the walls of the expansion volume and the blasting line and the sublimation of CO2 caused thereby tends to loosen the crust. Thus, the crust finally assumes an inhomogeneous, granulated and relatively brittle structure, with the result that the carrier gas passing-by with high speed permanently erodes coarse dry ice particles from the crust, and these particles then form part of the blasting material.

The desired production of such a crust of dry ice can be brought about or assisted by the presence of swirl edges in the flow path and by the swirling of the dry snow caused thereby. Thus, according to another embodiment of the invention, the blasting apparatus has at least one swirl edge in the flow path between the mouth of the feed line for the liquid CO2 and the blasting nozzle. This swirl edge may for example be formed at the transition point between the expansion volume and the blasting line, when the expansion volume opens laterally into the blasting line. Moreover, such swirl edges may also be formed by an internal threading in a pipe section forming the expansion volume or by stationary or moveable internal structures such as a propeller wheel, a worm or the like in the expansion volume.

Suitable for executing the method is also a blasting apparatus having a source of liquid CO2, an expansion nozzle connected to said source for generating dry snow, and a blasting nozzle connected to a pressure source and converging towards a constriction an diverging from the constriction for accelerating the dry snow, wherein the expansion nozzle is arranged upstream of the constriction.

Useful detailed and further developments of the invention are indicated in the dependent claims.

It has been found to be advantageous when the expansion volume enters into the straight blasting line at an angle of about 10 to 90°, preferably 20 to 45° in the flow direction. With this configuration, the flow of the carrier gas produces a certain drag, and the dry snow is gently deflected into the flow direction in the blasting line. Since the flow of the carrier gas in the blasting line has a component transverse to the longitudinal direction of the expansion volume, it is to be expected that a vortex is created at least in the downstream portion of the expansion volume, which vortex prolongs the dwell time of the dry snow in the expansion volume and hence the agglomeration and the growth, respectively, of the particles and the crust, respectively, of dry ice. When the diameter of the blasting line is small, the angle of entry is preferably more acute in order to prevent the dry ice from impinging onto to the opposing wall of the blasting line.

In a suitable embodiment, the point of entry of the expansion volume into the blasting line is located in a small distance upstream of the blasting nozzle.

The blasting nozzle preferably has a constriction, so that the carrier gas and the blasting material are accelerated to high speed.

Particularly preferred is the configuration of the blasting nozzle as a Laval nozzle in which an acceleration to approximately sonic speed or supersonic speed is achieved. The distance between the point of entry of the expansion volume into the blasting line and the constriction of the blasting nozzle should preferably be larger than the diameter of the blasting line.

When dimensioning the Laval nozzle, it should be taken into account that the supply of dry ice immediately upstream of the nozzle reduces the temperature of the medium and increases the density thereof, which causes a shift in the working point of the Laval nozzle. In order to achieve an optimal cleaning effect, in the method according to the invention, the cross-sectional area of the constriction of the Laval nozzle should be selected larger than it would be selected in the case that the medium is supplied with like pressure and like flow rate only via the blasting line. Moreover, the sublimation of dry snow increases the gas volume and leads to an acceleration of the flow of gas before, in or behind the constriction of the nozzle. Depending on the pressure conditions, droplets of liquid CO2 may also enter into the blasting line or the blasting nozzle and evaporate there. By regulating the flow of carrier gas, the position where this evaporation and/or sublimation takes place can be adjusted such that an optimal jet speed is achieved.

When the flow rate of the carrier gas is too large so that a high dynamic pressure is built up in front of the blasting nozzle, the amount and the cleaning effect of the generated dry snow is reduced. It is therefore convenient to provide a metering valve in the blasting line upstream of the point of entry of the expansion volume, for optimally adjusting the flow rate of the carrier gas. Preferably, another metering valve is provided in the feed line for liquid CO2 immediately at the point of entry into the blasting apparatus, so that the ratio of flow rates of carrier gas and CO2 may be adjusted immediately at the blasting apparatus.

All the measures discussed above may suitably be combined with one another.

In a useful further development of the method, a small amount of water or of another solid or liquid blasting material (e.g. solid dry ice pellets) is injected into the flow of carrier gas and/or into the expansion volume in order to further enhance the cleaning effect.

BRIEF DESCRIPTION OF THE DRAWINGS

Embodiment examples will now be explained in conjunction with the drawings, in which.

Figure 1:
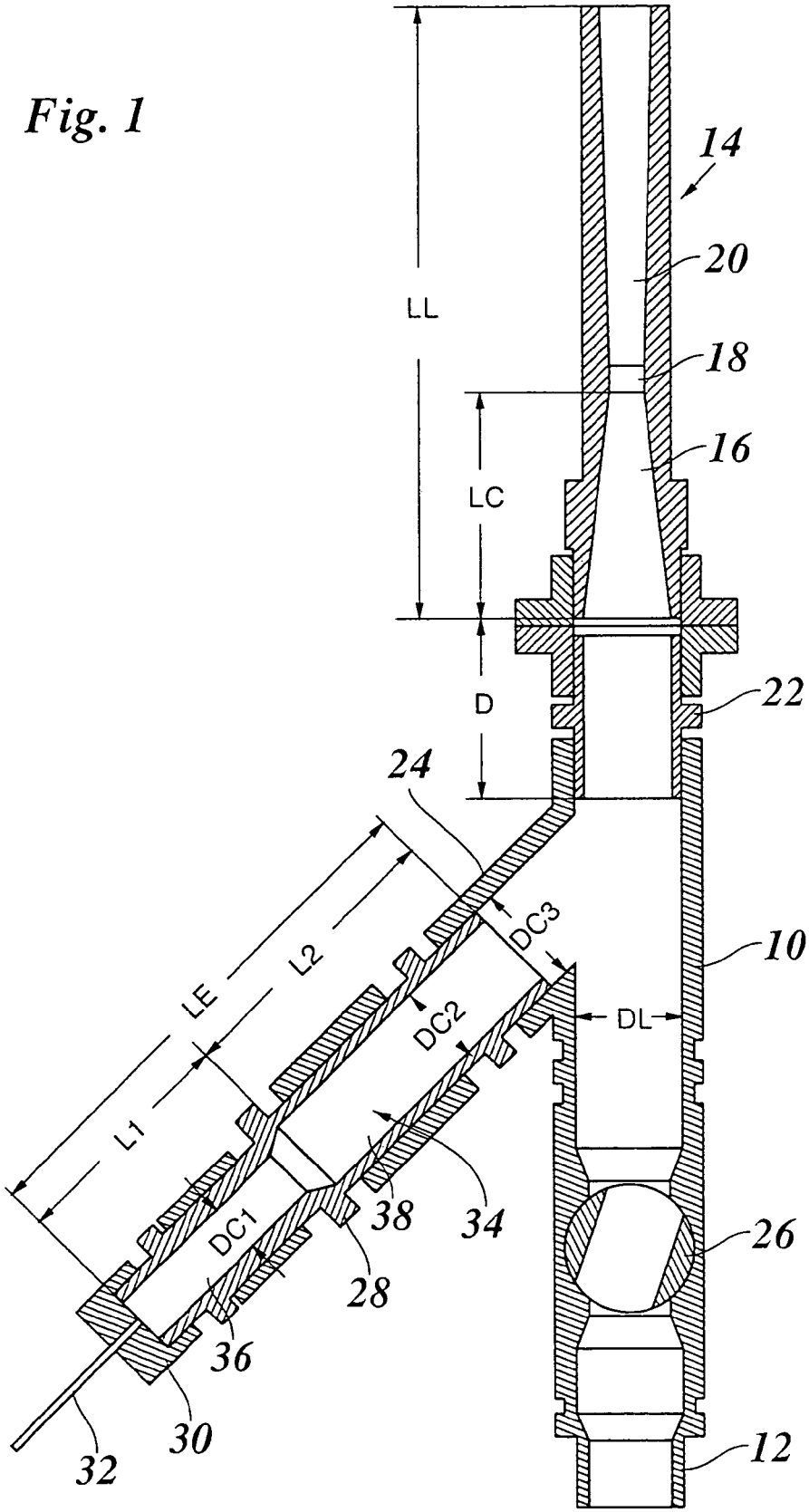
FIG. 1 shows a sectional view of a blasting apparatus for carrying out the method according to the invention.

As is shown in FIG. 1, a blasting line 10 is formed by a straight cylindrical pipe which has an internal diameter DL of 39 mm. An inlet port 12 of the blasting line is connected to a compressor which has not been shown and from which compressed air is supplied with a pressure of 1.1 MPa, for example. The blasting nozzle 14 configured as a Laval nozzle is coupled to the mouth of the blasting line 10. The blasting nozzle has a convergent section 16 the internal diameter of which decreases from 32 mm at the upstream end to 12.5 mm at a constriction 18, and a divergent section 20 the internal diameter of which increases from the constriction 18 to 19 mm at the downstream end. The total length LL of the blasting nozzle is 224 mm. The length LC of the converging section 16 is 83 mm.

A connecting sleeve 22 between the blasting line 10 and the Laval nozzle 14 has an internal diameter of approximately 32 mm, corresponding to the upstream diameter of the blasting nozzle.

Immediately upstream of the connecting sleeve 22 the pipe forming the blasting line 10 has a branch 24 which enters into the blasting line 10 at an angle of 45° in flow direction. The distance D between the branch 24 and the upstream end of the blasting nozzle 14 is approximately 66 mm. A metering valve 26, a ball valve for example, is arranged in the blasting line 10 upstream of the branch 24. A tubular transition piece 28 is screwed into the branch 24, and the upstream end of the transition piece is connected to a flexible feed line 32 for liquid CO2 through an adapter 30.

The feed line 32 is connected to a pressure bottle, which has not been shown and which accommodates an amount of CO2 under such a pressure that the CO2 remains liquid at environmental temperature. This pressure amounts to approximately 5.5 MPa, for example, for an environmental temperature of 20° C. The feed line 32 has an internal diameter of 3 mm. The liquid CO2 exits through the feed line 32 due to the differential pressure, without any need for active displacement means. The flow rate is limited by the small cross section of the feed line 32.

The transition piece 28 forms an expansion volume 34 which has two sections 36, 38 with different diameters. The upstream section 36 directly adjacent to the feed line 32 has an internal diameter DC1 of 20 mm and a length L1 of 85 mm. The downstream section 38 adjoins via a short conical section and has an internal diameter DC2 of 32 mm and a length L2 of 105 mm. The total length LE of the expansion volume 34 is thus 190 mm. The branch 24 has an internal diameter DC3 of 39 mm, identical with the internal diameter DL of the blasting line 10.

At the point in the adapter 30 where the feed line 32 opens into the expansion volume 34, the liquid CO2 can expand abruptly. This causes a part of the CO2 to be evaporated. The evaporation and decompression leads to a reduction in temperature, so that another part of the liquid CO2, which is finely dispersed at entry into the expansion volume, condenses to fine particles of dry snow. Since the cross-sectional area of the upstream section 36 of the expansion volume 34 is approximately 44 times the cross-sectional area of the feed line 32, the mixture of gaseous CO2 and dry snow passes through the upstream section 36 of the expansion volume at moderate speed. At entry into the downstream section 38 the speed is reduced further. During the travel through the comparatively long expansion volume 34 the fine particles of dry snow may aggregate to larger particles (agglomeration). Since the flow velocity decreases upon entry into the downstream section 38 and, accordingly, the dynamic pressure increases, the particles may also grow to some extent through re-condensation of gaseous CO2. Thus, at entry into the still larger branch 24, relatively large dry snow particles have formed, which are now sucked by the drag of the compressed air passing through the blasting line 10 and are entrained towards the blasting nozzle 14. In the blasting nozzle 14, the compressed air and the dry snow are accelerated to high speed, possibly to supersonic speed, so that a jet with high cleaning efficiency exits from the blasting nozzle. When this jet impinges on a surface to be cleaned, the dry snow acts as a blasting material for efficiently cleaning the surface.

Experiments have shown that the cleaning effect of the jet that has been generated in this way depends on the dimension of the expansion volume 34 and on the flow rate of compressed air in the blasting line 10. Without expansion volume, the cleaning effect is significantly reduced. Likewise, the cleaning effect is reduced dramatically when the flow rate of compressed air in the blasting line 10 is too large. For this reason, the flow rate is so adjusted by means of the metering valve 26 that an optimal production of dry snow and an optimal cleaning effect are achieved.

The embodiment example described above may be modified in various ways.

It is possible for example to use an angled blasting line instead of the straight blasting line 10, so that the expansion volume and the upstream section of the blasting line merge symmetrically into the downstream section of the blasting line. An arrangement in which the blasting line 10 is enlarged to an annular space which coaxially accommodates the expansion volume, is also conceivable.

In another embodiment, a hose section of considerable length may be provided between the point where the expansion volume opens into the blasting line, and the blasting nozzle 14.

In order to produce increased amounts of dry snow, it is possible to have a plurality of feed lines 32 entering into the blasting line 10 via respective expansion volumes. The points of entry of the expansion volumes into the blasting line may be distributed over the periphery of the blasting line and/or may be offset in axial direction. It is also possible to have a plurality of feed lines 32 opening into a common expansion volume.

Instead of compressed air, another carrier gas may be supplied via the blasting line 10. Another blasting material may be added to this carrier gas or to the compressed air. Likewise is it conceivable to have additional solid or liquid blasting media entering into the blasting line via lateral feed lines upstream or downstream of the branch 24 or possibly also into the expansion volume 34.

Figure 2:
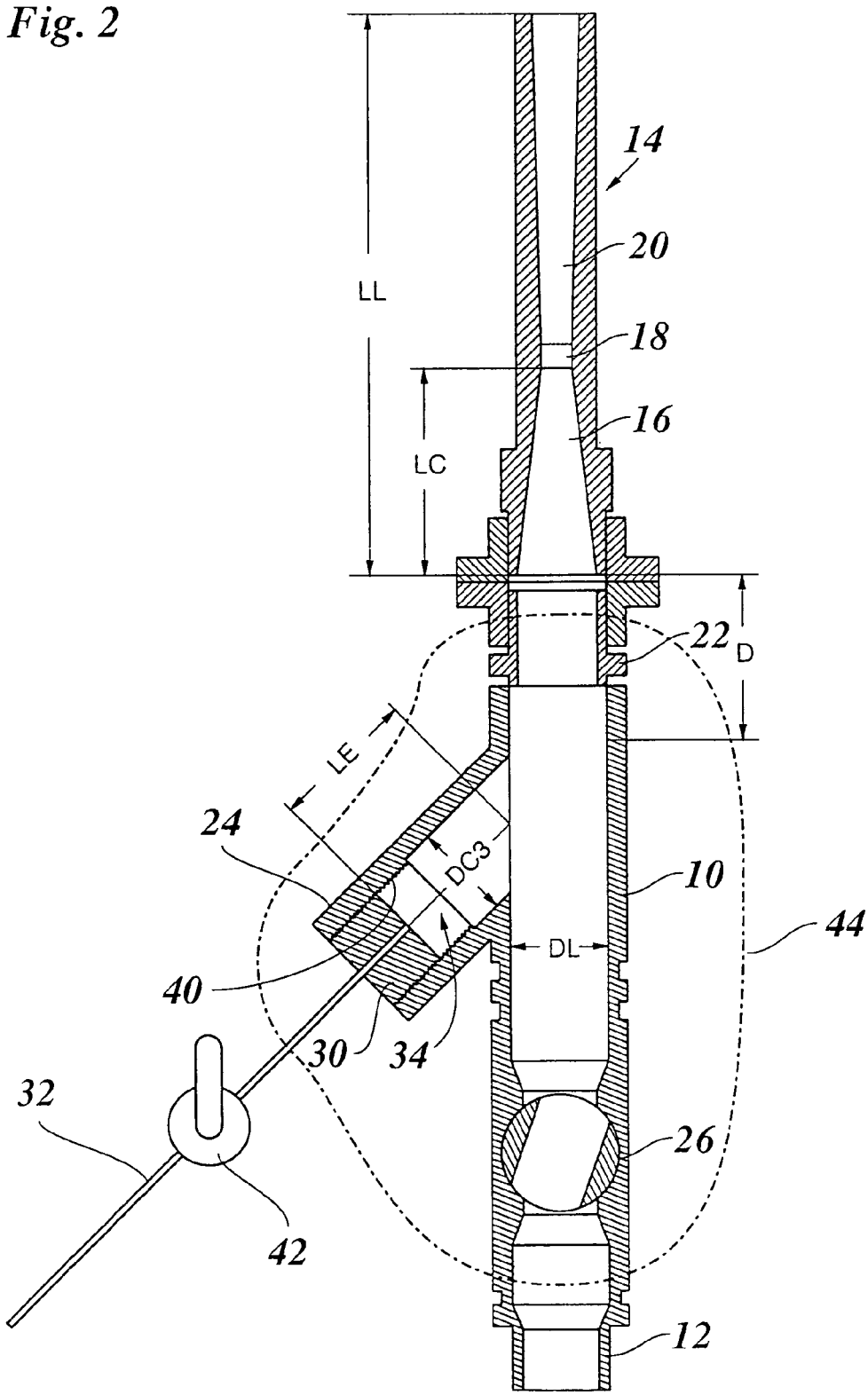
FIG. 2 is a sectional view of a blasting apparatus according to modified embodiment.

FIG. 2 shows a blasting apparatus according to a modified embodiment. Here, the expansion volume 34 is formed only by the interior of the branch 24. This branch has an internal threading 40 into which the adapter 30 has been screwed-in. A metering valve 42 is provided in the feed line 32 at a small distance upstream of the adapter 30, so that the flow rate of liquid CO2 may be adjusted. A flow rate of liquid CO2 of approximately 0.1 to 0.3 kg per m3 carrier gas (air) has proved to be a favourable setting (the flow rate of carrier gas is given as the volume of carrier gas under atmospheric pressure).

The portion of the blasting line 10 which includes the branch 24, and the portion of the feed line 32 directly adjacent to the adapter 30 are embedded in a sheath of thermally insulating material which has been shown in dotted lines in the drawing. This facilitates not only the handling of the pistol-type blasting apparatus but also improves the thermal insulation of the expansion volume 34 and the portion of the feed line adjacent thereto, so that a low temperature in the expansion volume is achieved.

Figure 3:
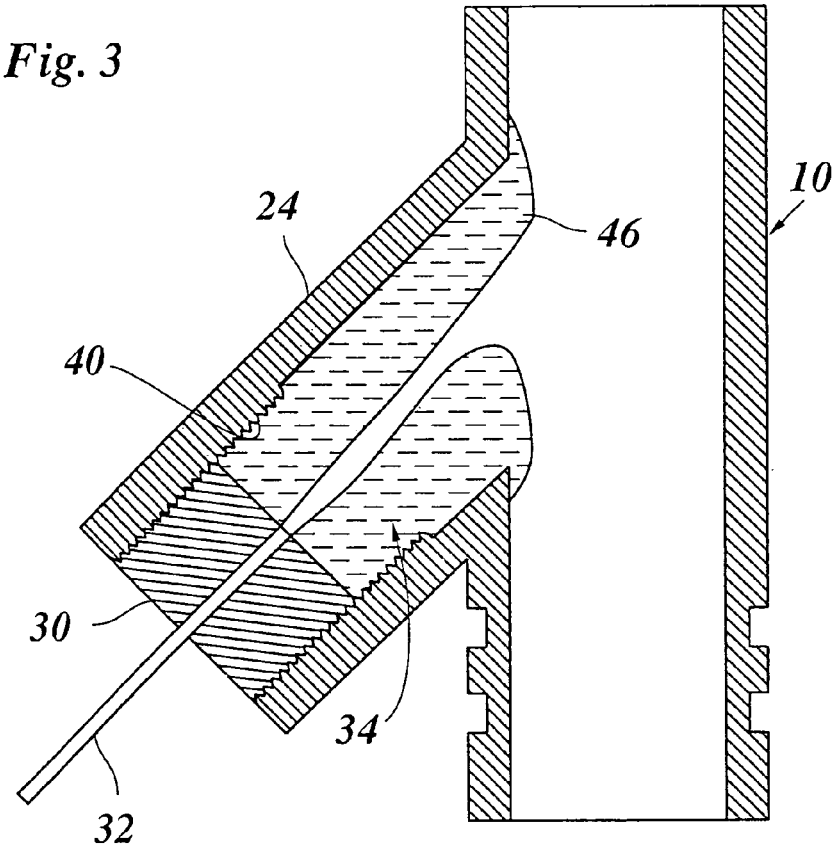
FIG. 3 shows an enlarged detail of FIG. 2.

In FIG. 3, the branch 24 has been shown in an enlarged scale. It can be seen that the internal threading 40 extends beyond the adapter 30 and forms a part of the internal wall of the expansion volume 34. The flow path for the dry snow from the mouth of the feed line 32 into the blasting line 10 is limited by a number of swirl edges. A first swirl edge is formed directly by the abrupt increase in cross section from the feed line 32 to the internal cross section of the expansion volume 34 at the internal surface of the adapter 30. Other swirl edges are found at the point of entry of the branch 24 into the blasting line 10. Moreover, the grooves of the internal threading 40 also act as swirl edges. These swirl edges cause the dry snow forming in the expansion volume 34 to swirl, and especially the internal threading 40 promotes the adhesion of dry snow at the walls of the branch 24, so that a relatively compact but brittle crust 46 of dry ice is formed in the expansion volume and to some extent also in the blasting line 10. The CO2 which is spayed out of the feed line 32 and is evaporated thereby forces its way through the crust of dry ice. This CO2 and the carrier gas flowing at high speed through the blasting line 10 and past the crust 46 permanently erode small particles of dry ice from the crust. These relatively coarse and hard particles then form a very efficient blasting material by which a high cleaning effect of the blasting apparatus is achieved. The particles of dry ice may even grow further on their way through the blasting nozzle 14, because they are swept and accelerated by the carrier gas which contains finer particles of dry snow. The exact location where the agglomeration of dry ice and the formation of the crust 46 takes place depends on the specific conditions and may shift (in both directions) more or less into the blasting line 10 and possibly into the blasting nozzle 14.

In the example shown, the expansion volume 34 has the same internal diameter as the blasting line 10, it may however has have a smaller internal diameter, if desired. The angle at which the branch 24 merges into the blasting line 10 may also be varied, preferably in a range between 20 and 45°.

In the example shown in FIG. 2 the length LE of the expansion volume (measured on the central axis) is approximately 49 mm, and the diameter DC3 of the expansion volume is 32 mm. Then, the expansion volume 34 has a volume V of approximately 39 cm3. When the feed line 32 has an internal cross-sectional area of 7 mm2, corresponding to a diameter of 3 mm, the ratio V1/3/A1/2 is approximately 12.8. In practise, the air flow rate through the blasting line 10 is preferably between 3 and 10 m3/min, with an optimum at about 5.5 m3/min. For a CO2/air ratio of 0.3 kg/m3, the corresponding flow rates j of CO2 are approximately 0.0015 kg/s to 0.05 kg/m3 and 0.023 kg/s, respectively, for the optimum. The corresponding values for the ratio V/j are then 0.0026-0.0008 m3 s/kg and 0.0018 m3 s/kg for the optimum. The constriction 18 of the blasting nozzle 14 has a diameter of 13.1 mm.

In another embodiment, which has not been shown, the blasting line 10 has a smaller internal diameter of 12.7 mm, the diameter DC3 of the expansion volume 34 is also 12.7 mm, and the length LE of the expansion volume is approximately 37 mm. In this case, the expansion volume has a volume V of about 4.7 cm3. The air flow rate is then preferably between 1.5 and 2.5 m3/min. When the CO2/air ratio is again 0.3 kg/m3, one obtains a value between 0.00062 and 0.00037 m3 s/kg for the ratio V/j. The value of $V1/3/A^{1/2}$ is in this case approximately 6.3. In this case the constriction 18 of the blasting nozzle 14 preferably has a diameter of 8 mm.

Under these conditions, supersonic speed can be reached downstream of the blasting nozzle 14.

It is convenient to provide a baffle at the mouth of the blasting nozzle in order to reduce the generation of noise.

Figure 4:
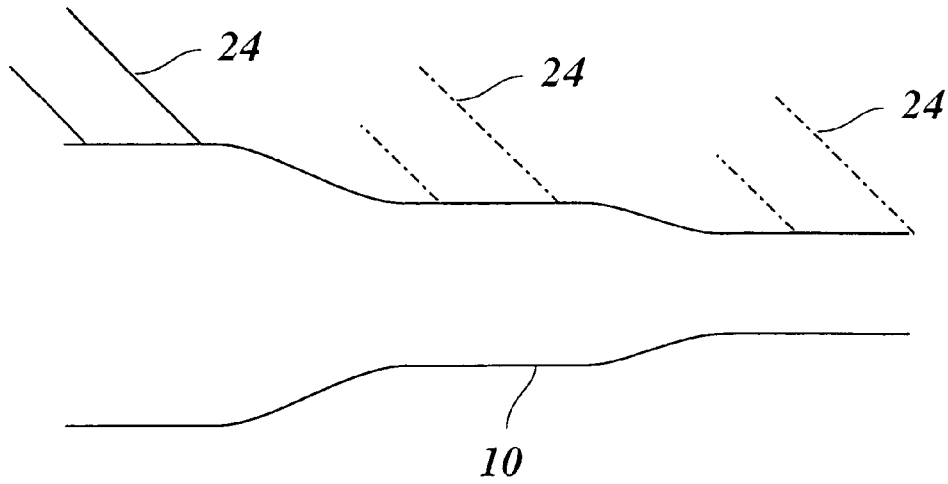
FIG. 4 is a schematic sectional view of a blasting line which tapers step-wise.

Whereas, in the examples described above, the internal cross section of the blasting line remains essentially constant, embodiments are possible in which this internal cross section varies. For example, the internal cross section of the blasting line may be reduced in two steps, with smooth transitions, as is shown in FIG. 4. Possible positions for the branch 24 have also been shown in FIG. 4.

As will be understood from the examples given above, the expansion volume should not be too small and, in particular, should not have a too small length. In an embodiment which is presently considered to be preferable, the length of the expansion volume is 100 mm or more.

Whereas the feed line 32 has an internal diameter of 3 mm in the shown embodiments, other embodiments are possible, in which the feed line 32 upstream of the expansion volume 34 or preferably at the point of entry into the expansion volume has a diameter of only 1.0 or 1.3 mm.

For supplying liquid CO2 via the feed line 32, optionally, a cold tank may be provided in which the CO2 is kept liquid at a temperature of approximately −20° C. and at a pressure of less than 2.2 MPa, e.g. 1.8 MPa.

Figure 5:
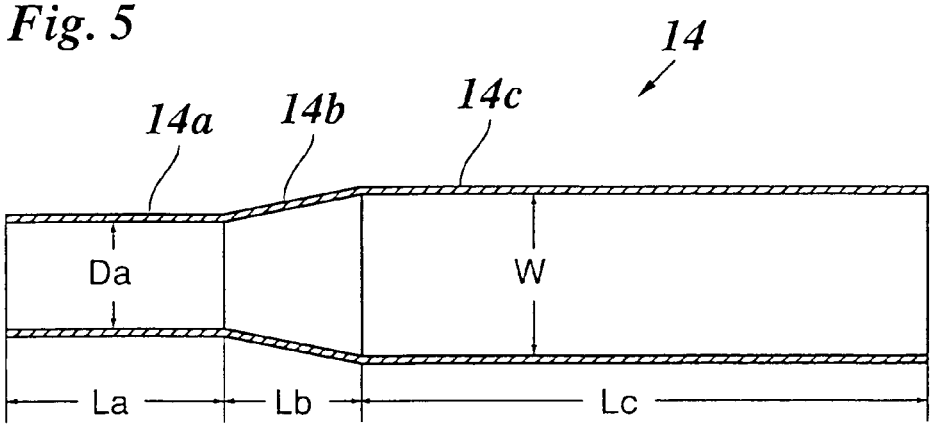
FIGS. 5 to 7 show sectional and front views of a nozzle of the blasting apparatus.
Figure 6:
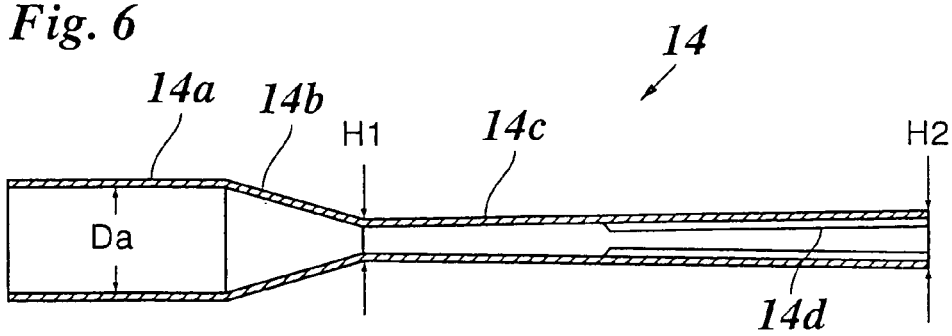
Figure 7:
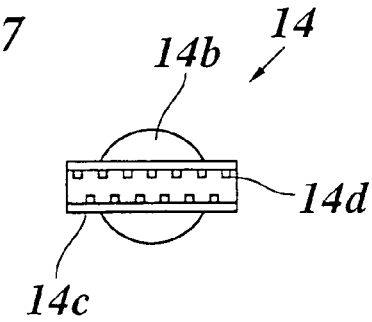

FIGS. 5 to 7 show a modified embodiment of the blasting nozzle 14, which has the function of a Laval nozzle but is configured as a flat nozzle and permits to create a fan-like divergent jet having a relatively uniform density and velocity profile over its width. This blasting nozzle has, on the upstream end, a cylindrical portion 14*a* with a length La and an internal diameter Da, which is adjoined by a transition piece 14*b* with the length Lb. Adjoining on the downstream side is a flattened section 14*c* with a length Lc and a rectangular internal cross section. The transition piece 14*b* serves for adapting the cylindrical internal cross section of the section 14*a* to the rectangular internal cross section of the section 14*c*. This rectangular internal cross section has an essentially constant with W and a height which increases from a value H 1 at the constriction, at the end of the transition piece 14*b* to a somewhat larger value H2 at the mouth. In this way, an increase in cross-sectional area in accordance with the principle of a Laval nozzle is achieved, although the width W is practically constant. If at all, the width W may increase slightly in the vicinity of the mouth.

In a practical embodiment, the blasting nozzle 14 according to FIGS. 5 to 7 has the following dimensions:

| | |
|---|---|
| La = | 55 mm |
| Lb = | 55 mm |
| Lc = | 130 mm |
| Da = | 27 mm |
| W = | 45 mm |
| H1 = | 3.0-4.0 mm |
| H2 = | 7, 5 mm |

The following dimensions apply to another embodiment example:

| | |
|---|---|
| La = | 34 mm |
| Lb = | 76 mm |
| Lc = | 130 mm |
| Da = | 12 mm |
| W = | 16 mm |
| H1 = | 2.25-2.60 mm |
| H2 = | 3.75 mm. |

The internal surface in the flattened section 14*c* has corrugations which, in the example shown, are formed by longitudinal ribs 14*b*. Such corrugations lead to a significant reduction of noise, especially in the supersonic mode.

The invention claimed is:

1. Blasting method for cleaning surfaces, wherein liquid $CO_2$ is supplied via a feed line (32) into an expansion volume (34) having an enlarged cross section, is transformed into dry snow by expansion, and is fed under pressure, together with a carrier gas to a blasting nozzle (14), wherein the volume V of the expansion volume and the internal cross-sectional area A of the feed line (32) fulfill the relation $V^{1/3}/A^{1/2}>3$, and the mixture of carrier gas and dry snow is accelerated in the blasting nozzle (14) to at least approximately sonic speed, characterised in that the carrier gas is supplied under pressure through a blasting line (10) to the blasting nozzle (14), the liquid $CO_2$ is transformed into dry snow in the expansion volume (34) apart from the carrier gas in the blasting line (10) and the dry snow is introduced from the expansion volume (34) into the blasting line (10) upstream of the blasting nozzle (14).

2. Blasting method according to claim 1, characterised in that the volume V of the expansion volume and the internal cross-sectional area A of the feed line (32) fulfill the relation $V^{1/3}/A^{1/2}>10$.

3. Blasting method according to claim 1, characterised in that the flow rate proportion of $CO_2$ to carrier gas is at least 0.1 $kg/m^3$, preferably at least 0.25 $kg/m^3$.

4. Blasting method according to claim 1, characterised in that the proportion of the volume V of the expansion volume (34) to the flow rate of $CO_2$ amounts to at least 0.0002 $m^3$ s/kg.

5. Blasting method according to claim 1, characterised in that the expansion volume (34) is thermally insulated from the environment.

6. Blasting method according to claim 5, characterised in that the portion of the feed line (32) adjacent to the expansion volume (34) is also thermally insulated from the environment.

7. Blasting method according to claim 1, characterised in that a deposition of solid dry ice at the walls of the expansion volume (34) and/or the blasting line (10) is caused by swirl edges (40) in the expansion volume or at the downstream end thereof.

8. Method according to claim 1, characterised in that the flow of carrier gas is throttled by means of a metering valve (26) upstream of the point of entry of the expansion volume (34) into the blasting line (10).

9. Method according to claim 8, characterised in that the carrier gas is supplied to the metering valve (26) with a pressure of at least 0.1 MPa, preferably about 1.0 to 2.0 MPa.

10. Method according to claim 1, characterised in that the $CO_2$ is supplied via the feed line (32) at environmental temperature and under a pressure necessary for maintaining the liquid state.

11. Method according to claim 1, characterised in that the $CO_2$ is supplied through the feed line (32) at a temperature of less than −15° C. and at a pressure necessary for maintaining the liquid state.

12. Method according to claim 1, characterised in that the volume flow rate of the carrier gas is at least 0.75 $m^3$/min.

13. Blasting method for cleaning surfaces, wherein liquid $CO_2$ is supplied via a feed line (32) into an expansion volume (34) having an enlarged cross section, is transformed into dry snow by expansion, and is fed under pressure, together with a carrier gas to a blasting nozzle (14), wherein the volume V of the expansion volume and the internal cross-sectional area A of the feed line (32) fulfill the relation $V^{1/3}/A^{1/2}>3$, and the mixture of carrier gas and dry snow is accelerated in the blasting nozzle (14) to at least approximately sonic speed, wherein the carrier gas is supplied under pressure through a blasting line (10) to the blasting nozzle (14), and the liquid $CO_2$ is introduced from the expansion volume (34) into the blasting line (10) upstream of the blasting nozzle (14), characterised in that the blasting nozzle (14) has a constriction (18), a mixture of gaseous, liquid and solid $CO_2$ is produced in the expansion volume, and a part of the solid and liquid components evaporate in the blasting line or the blasting nozzle, and in that the position of the evaporation zone relative to the constriction (18) is determined by regulating the flow of carrier gas.

14. Apparatus for cleaning surfaces, comprising: an expansion volume (34) having a volume V, a feed line (32) having an internal cross-sectional area A for supplying liquid $CO_2$, which opens into the expansion volume (34), the volume V of the expansion volume and the internal cross-sectional area A of the feed line (32) fulfilling the relation $V^{1/3}/A^{1/2}>3$, a convergent/divergent blasting nozzle for discharging a mixture of a carrier gas and $CO_2$ in the form of dry snow, and a blasting line (10) for supplying the carrier gas under pressure, wherein the expansion volume (34) opens into the blasting line (10) and is located between the feed line (32) and the blasting line (10) such that the liquid $CO_2$ is transformed into dry snow in the expansion volume (34) apart from the carrier gas in the blasting line (10), and wherein the blasting nozzle (14) is connected to the downstream end of the blasting line (10).

15. Apparatus according to claim 14, characterised in that the blasting nozzle (14) is a Laval nozzle.

16. Apparatus according to claim 14, characterised in that the cross section of the expansion volume (34) increases from the feed line (32) towards the blasting line (10).

17. Apparatus according to claim 14, characterised in that at least one swirl edge (40) is formed in the expansion volume (34) and/or at the transition between the expansion volume (34) and the interior of the blasting line (10).

18. Apparatus according to claim 14, characterised in that the internal cross section of a downstream section (38) of the expansion volume (34) is approximately equal to the internal cross section of the blasting line (10).

19. Apparatus according to claim 14, characterised in that the expansion volume (34) enters into a straight section of the blasting line (10) from one side.

20. Apparatus according to claim 19, characterised in that the expansion volume (34) enters into the blasting line (10) at an angle from 5 to 90° in flow direction.

21. Apparatus according to claim 14, characterised in that the expansion volume (34) has a length of at least 15 mm, preferably at least 49 mm.

22. Apparatus according to claim 14, characterised in that the internal diameter of the blasting nozzle (14) at its inlet opening is approximately equal to the internal diameter of the blasting line (10), and in that the internal diameter of a constriction (18) of the blasting nozzle is approximately 15 to 75%, preferably about 35 to 45% of the diameter at the inlet opening.

23. Apparatus according to claim 14, characterised in that the distance between the point of entry of the expansion volume (34) into the blasting line (10) and the constriction (18) of the blasting nozzle (14) is larger than the diameter (DL) of the blasting line (10).

24. Apparatus according to claim 14, characterised in that a metering valve (26) is arranged in the blasting line (10) upstream of the point of entry of the expansion volume (34).

25. Apparatus according to claim 14, characterised in that a metering valve (42) is arranged in the feed line (32) directly upstream of the expansion volume (34).

26. Apparatus according to claim 14, characterised in that the length of the expansion volume (34) amounts to at least 15 mm, preferably at least 30 mm.

27. Apparatus according to claim 14, characterised in that the blasting nozzle (14) is a flat nozzle, having a cylindrical section (14*a*), a transition piece (14*b*) and a flattened section (14*c*), the flattened section having an approximately rectangular internal cross section.

* * * * *